United States Patent [19]

Bowers et al.

[11] 4,262,271

[45] Apr. 14, 1981

[54] SOLENOID HAVING NON-ROTATING PLUNGER

[75] Inventors: William S. Bowers, Grand Blanc; Thomas M. Herman, Flint; Carlen E. Larson, Davison, all of Mich.

[73] Assignee: General Motors Corporation, Detroit, Mich.

[21] Appl. No.: 110,107

[22] Filed: Jan. 7, 1980

[51] Int. Cl.[3] ..... H01F 7/16

[52] U.S. Cl. ..... 335/263; 335/274

[58] Field of Search ..... 335/249, 251, 255, 261, 335/263, 274, 279

[56] References Cited

U.S. PATENT DOCUMENTS

| | | | |
|---|---|---|---|
| 2,331,942 | 10/1943 | Turnbull et al. | 335/263 X |
| 3,062,992 | 11/1962 | Dahl et al. | 335/261 X |
| 3,259,811 | 7/1966 | Dunn | 335/263 X |
| 3,509,506 | 4/1970 | Bird | 335/274 |
| 3,593,240 | 7/1971 | Garczynski | 335/261 X |
| 3,813,625 | 5/1974 | Kinsella | 335/263 |

*Primary Examiner*—George Harris

*Attorney, Agent, or Firm*—C. R. Meland

[57] ABSTRACT

An electromagnetic solenoid incorporating a plunger return mechanism comprising a spring retainer non-rotatably fitted to the plunger, and a spring held in compression between the retainer and a coil wound bobbin disposed about the plunger. The spring is held non-rotatable with respect to the bobbin and the plunger, and the plunger is non-rotatable with respect to the bobbin so that the spring cannot unwind with respect to the spring retainer.

2 Claims, 4 Drawing Figures

SOLENOID HAVING NON-ROTATING PLUNGER

This invention relates to an electromagnetic solenoid assembly and more particularly to a return mechanism for a solenoid plunger.

Electromagnetic solenoids generally comprise a plunger, a coil for actuating the plunger, and means for restraining the axial and radial movement of the plunger. The plunger of a solenoid is usually actuated to control a load device, and in most cases, it is essential that the plunger be positively returned to an off or rest position upon deenergizaton of the coil. If the plunger return mechanism fails to return the plunger to a rest position, the load device may remain in the position to which it was actuated, leading to an undesired result. One type of plunger return mechanism comprises a spring held in compression between a bobbin about which the coil is wound and a spring retainer secured to an end of the plunger. Under certain circumstances involving repeated actuation of the solenoid, it has been found that the return spring may rotate relative to the plunger or the spring retainer. If such rotation occurs, it is possible for the return spring to unwind around the spring retainer so that less than the full length of the spring remains in compression between the bobbin and the spring retainer. In the above condition, the plunger return force is weakened, increasing the likelihood of improper or incomplete plunger return after the solenoid is deenergized.

It is therefore an object of this invention to provide an electromagnetic solenoid having an improved spring actuated plunger return mechanism whereby the return spring is prevented from rotating with respect to a spring retainer.

It is another object of this invention to provide an electromagnetic solenoid comprising a bobbin having a coil wound thereon, a plunger nonrotatably disposed within the bobbin, a spring retainer non-rotatably secured to the plunger, and a return spring held in compression between the bobbin and the spring retainer wherein the return spring is prevented from rotating with respect to the bobbin, the plunger and the spring retainer.

These objects are carried forward by providing a plunger of non-circular cross section, a coil wound bobbin having an opening therethrough of cross section complimentary to that of the plunger and having a spring receiving projection on an end face thereof, a spring retainer adapted to be non-rotatably secured to an end of the plunger, and a spring disposed about the plunger and held in compression between the bobbin and the spring retainer, one end of the spring being non-rotatably secured to the spring receiving projection on the bobbin, and the other end of the spring being non-rotatably secured to the plunger. As a result, return spring unwinding is prevented and the plunger is consistently returned to a rest position upon deenergization of the solenoid.

IN THE DRAWINGS

Figure 1:
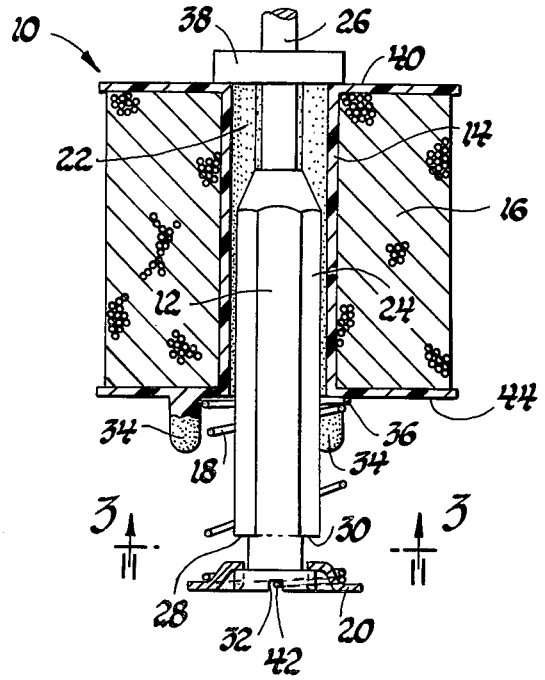
FIG. 1 is a sectional view of the solenoid and plunger return mechanism of this invention.

Referring now to FIG. 1, reference numeral 10 generally designates a solenoid made in accordance with this invention, comprising plunger 12, bobbin 14, coil 16, return spring 18, and spring retainer 20. An octagonal opening 22 is provided through bobbin 14, and plunger 12 is provided with a complimentary octagonal cross sectional surface 24 so that plunger 12 may be slidably and non-rotatably disposed within bobbin 14. One end of plunger 12 (designated by reference numeral 26) may be adapted to actuate a load device such as a spring loaded switch. The other end of plunger 12 is provided with spring retainer slots 28 and 30 and a spring slot 32 on the end face. Spring 18 is disposed about plunger 12 and held in compression between end face 44 of bobbin 14 and spring retainer 20, which engages plunger 12 on retainer slots 28 and 30. Bobbin 14 is provided with one or more projections 34 which limit the radial movement of spring 18. In addition, one end of spring 18 has a loop portion 36 disposed about one of the bobbin projections 34 to prevent spring 18 from rotating with respect to bobbin 14. The other end of spring 18 has a straightened portion 42 disposed within plunger spring slot 32 in order to prevent spring 18 from rotating with respect to plunger 12. It should be appreciated that with this type of plunger return mechanism, means must be provided for restraining the movement of plunger 12 upon deenergization of solenoid coil 16. For this purpose blocking plate 38 is secured to the load actuating portion of plunger 12 so that upon deenergization of solenoid coil 16, blocking plate 38 contacts end face 40 of bobbin 14 and thereby prevents further movement of plunger 12.

Figure 2:
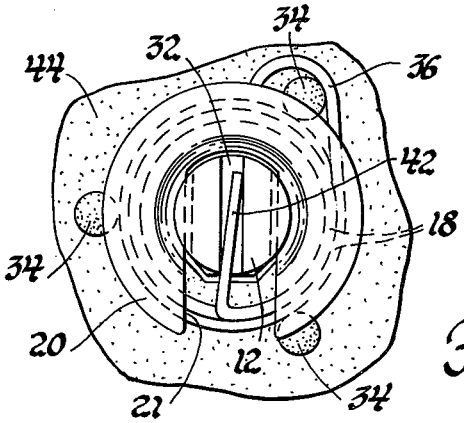
FIG. 2 is an end view of the plunger and spring return mechanism, illustrating the spring retainer and the means by which the spring is nonrotatably secured to the plunger and the bobbin.

FIG. 2 shows an end view of the invention in order to more clearly illustrate the manner by which spring 18 is secured. The elements shown in this figure that correspond to elements depicted in FIG. 1, have been assigned the same reference numerals. As indicated before, spring 18 is disposed about plunger 12 between spring retainer 20 and bobbin end face 44, and is secured to plunger 12 at one end (via spring portion 42 and plunger slot 32) and to bobbin 14 at the other end (via spring loop 36 and bobbin projection 34). Spring retainer 20 has a lateral recess 21 and is located about plunger 12 as will be described.

Figure 3:
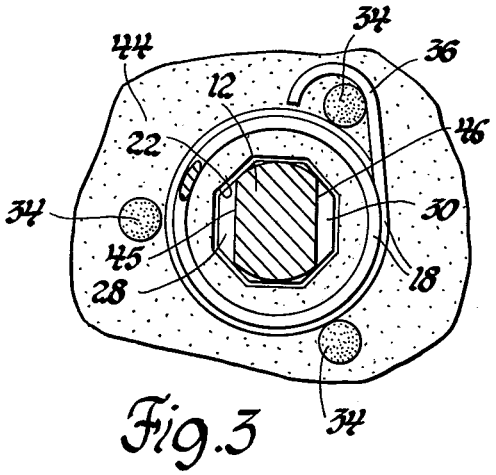
FIG. 3 is a sectional view of the plunger taken along lines 3—3 as indicated in FIG. 1.

FIG. 3 is a cross sectional view of plunger 12, illustrating plunger slots 28 and 30. It should be noted that slots 28 and 30 form flat faces 45 and 46 on lateral surfaces of plunger 12. As shown in FIG. 2, spring retainer 20 has a lateral recess formed therethrough that is complimentary with plunger slots 28 and 30 so that when spring retainer 20 is located thereon, the complimentary engaging surfaces referred to above prevent spring retainer 20 from rotating with respect to plunger 12. Other elements shown in FIG. 3 that correspond to elements previously described in reference to FIGS. 1 and 2 have been assigned the same reference numerals.

Figure 4:
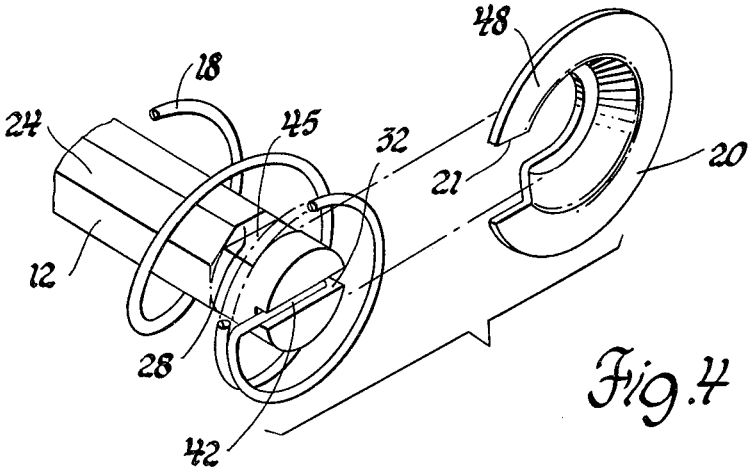
FIG. 4 is an exploded view of the plunger, the return spring and the spring retainer, illustrating their assembly and spacial relationship.

FIG. 4 is an exploded perspective view, illustrating the interlocking relationship between plunger 12, return spring 18, and spring retainer 20. When assembled, return spring 18 exerts a force against rim 48 of spring retainer 20, holding spring retainer 20 in place. Also, spring end 42 is held against the end face of plunger slot 32 to prevent slippage.

In the drawings, the solenoid is shown in the deenergized position. When solenoid coil 16 is energized with a suitable source of direct current, plunger 12 assumes an energized position, fully compressing return spring 18 and actuating a load device (not shown). Upon deenergization of solenoid coil 16, return spring 18 returns plunger 12 to the rest position as shown in FIG. 1.

Upon close inspection of the figures, it will be seen that the solenoid assembly of this invention positively prevents the unwinding of return spring 18 relative to spring retainer 20. Firstly, return spring 18 is held non-rotatable relative to plunger 12. This effect is independently achieved by two of the interlocking means described in reference to FIGS. 1–4. Specifically, return spring 18 is non-rotatably secured to plunger 12 due to (1) the connection of spring portion 42 to plunger slot 32, and (2) the combination of the connection between return spring 18 and bobbin projection 34, and the non-rotatable fit of plunger 12 within bobbin 14. Secondly, spring retainer 20 is held non-rotatable relative to plunger 12. This result is achieved due to the engagement of plunger faces 45 and 46 with the complimentary recess 21 of spring retainer 20. As a result of the above mentioned relationships, return spring 18 is non-rotatable relative to spring retainer 20. Accordingly, return spring 18 cannot unwind about spring retainer 20 and a consistent return spring force is ensured for the life of the solenoid.

It should be appreciated that a frame member (not shown) may be attached to bobbin 14 and secured to a rigid support structure for the purpose of defining the travel path of plunger 12 upon actuation of the solenoid.

Although this invention has been described in reference to specific embodiments, it is not meant to be limited thereto, and various modifications may be made without departing from its spirit and scope.

The embodiments of the invention in which an exclusive property or privilege is claimed are defined as follows:

1. An electromagnetic assembly comprising a magnetic plunger having a noncircular cross section, one end of said plunger being adapted to actuate a load device and the other end having spring retainer receiving slots on lateral faces thereof, a bobbin having an opening therethrough defined by inner walls of cross section complimentary with that of said plunger, said plunger being disposed in said bobbin opening whereby said plunger may be shifted axially within said bobbin but is prevented from rotating respect to said bobbin, an electrically energizable coil wound about said bobbin for selectively generating an electromagnetic field about said plunger, a spring retainer having a laterally extending recess therethrough complimentary to and engagingly disposed about said spring retainer receiving slots on said plunger providing a non-rotatable connection between said spring retainer and said plunger, a spring disposed about said plunger and held in compression between said bobbin and said spring retainer, means for limiting the movement of said plunger upon deenergization of said coil, whereby said electromagnetic field operates to shift said plunger to a first position when said coil is energized and said spring operates to shift said plunger to a second position when said coil is deenergized, means for preventing rotation of said spring with respect to said bobbin, and means for preventing rotation of said spring with respect to said plunger whereby said spring is prevented from rotating with respect to said spring retainer.

2. An electromagnetic assembly comprising a plunger formed of magnetic material having a noncircular cross section, one end of said plunger being adapted to actuate a load device and the other end having spring retainer receiving slots on lateral faces thereof and a spring receiving slot on the end face thereof, a bobbin having an opening therethrough defined by an inner wall of cross section complimentary with that of said plunger, said plunger being disposed in said bobbin opening whereby said plunger may be shifted axially within said bobbin, but is prevented from rotating with respect to said bobbin, at least one spring receiving projection on an end face of said bobbin, an electrically energizable coil wound about said bobbin for selectively generating an electromagnetic field about said plunger, a spring retainer having a laterally extending recess therethrough complimentary with said spring retainer receiving slots on said plunger, said spring retainer recess being engagingly disposed about said spring retainer receiving slots providing a non-rotatable connection between said spring retainer and said plunger, and a spring disposed about said plunger, one end of said spring having a loop portion disposed about said spring receiving projection on said bobbin and the other end having a lineal portion disposed in said spring receiving slot on the end face of said plunger to hold said spring in compression between said end face of said bobbin and said spring retainer, whereby said spring urges said plunger to a rest position and said spring is prevented from rotating with respect to said bobbin, said plunger, and said spring retainer.

* * * * *